United States Patent [19]

Alexandrov et al.

[11] Patent Number: 4,585,078

[45] Date of Patent: Apr. 29, 1986

[54] ROTARY IMPACT TOOL

[76] Inventors: Vladimir M. Alexandrov, Kirovsky prospekt, 25, kv. 53; Anatoly I. Rabinov, Novocherkassky prospekt, 68, kv. 50; Mikhail I. Shalyapin, ulitsa Stasovoi, 2, kv. 164; Valery I. Jutkevich, prospekt Narodnogo Opolchenia, 241, korpus 2, kv. 28, all of Lenigrad, U.S.S.R.

[21] Appl. No.: 416,284

[22] Filed: Sep. 9, 1982

[51] Int. Cl.[4] ..... B25D 15/00

[52] U.S. Cl. ..... 173/93.5; 81/464; 81/465

[58] Field of Search ..... 173/93, 93.5, 93.6, 173/93.7, 94, 97; 81/463, 464, 466, 465

[56] References Cited

U.S. PATENT DOCUMENTS

| | | | |
|---|---|---|---|
| 2,463,656 | 3/1949 | Thomas | 173/93.5 |
| 3,072,232 | 1/1963 | Martin et al. | 173/93.5 |
| 3,321,043 | 5/1967 | Vaughin | 173/93.5 |
| 3,533,479 | 10/1970 | Madsen | 173/93.5 |
| 3,661,217 | 5/1972 | Maurer | 173/93.5 |
| 4,321,973 | 3/1982 | Maurer | 173/93.5 |
| 4,347,902 | 9/1982 | Wallace et al. | 173/93.5 |

*Primary Examiner*—Frank T. Yost
*Assistant Examiner*—Hien H. Phan
*Attorney, Agent, or Firm*—McAulay, Fields, Fisher, Goldstein & Nissen

[57] ABSTRACT

Disclosed is a rotary impact tool comprising a case enclosing a drive motor, a hammer member with an inner working surface provided with projections, an intermediate member transmitting rotation from the motor to the hammer member and including a guide made eccentric relative to the axis of rotation and intended to transmit rotation from the drive motor to the hammer member as well as to provide translation of the hammer member in a plane perpendicular to the axis of rotation, a spindle disposed coaxially with the intermediate member, embraced by the inner working surface of the hammer member, and having on its outer surface projections corresponding to the projections made on the inner working surface of the hammer member to transmit impulse rotation to the spindle.

2 Claims, 13 Drawing Figures

ROTARY IMPACT TOOL

FIELD OF THE INVENTION

The present invention relates to mounting and assembling equipment, and more particularly to rotary impact tools.

The invention can be used most advantageously in assembling and disassembling threaded connections, thread cutting and in the equipment which serves to hold and move articles, such as vices, jacks.

BACKGROUND OF THE INVENTION

Rotary impact tools are one of the most efficient means of mechanization employed in carrying out assembly and mounting operations. The principle of operation of such a tool is based on conversion of a drive motor continuous rotation into repetitive impulses (impacts) delivered by a high-mass rotary part (hammer member) to the output shaft (spindle) of the tool.

Due to the fact that the time of accumulation of kinetic energy by the hammer member is much greater than the time of collision (the time of transmission of the energy accumulated by the hammer member to the spindle), the force developed by the spindle is from 400 to 500 times greater than that on the shaft of the drive motor. This makes it possible to create high-power compact tools of a low mass. Another important advantage of rotary impact tools lies in the absence of a reaction torque transmitted to the hands of an operator.

Known in the prior art is a rotary impact tool (Cf. U.S. Pat. No. 2,718,803, U.S. Cl. 81-523) comprising a case enclosing a drive motor transmitting rotation through an intermediate member to a hammer member embracing a spindle. The spindle is coaxial with the intermediate member. It bears with its one end on the intermediate member and with its other end on the case. The spindle is provided with longitudinal projections made on its outer surface. These projections interact with corresponding projections on the inner surface of the hammer member. The hammer member is mounted to reciprocate along guide means in a plane perpendicular to the axis of rotation. The intermediate member transmitting rotation to the hammer member is mounted directly on the shaft of the drive motor and has a fork-like driver engaging with the projection on one of the end faces of the hammer member and transmitting rotation thereto through this projection. Translation of the hammer member in a plane perpendicular to the axis of rotation in this construction is provided by a pivot with the hammer member mounted to swing thereon. This pivot is fixed in a holder embracing the hammer member. As the hammer member rotates, the impact projections on the inner surface of the hammer member repeatedly, that is at every revolution, engage with (deliver impacts to) the longitudinal projections on the spindle outer surface. Swinging of the hammer member about the pivot (hammer member translation) provides disengagement of the hammer member projections from the spindle projections after collision and a required orientation of the hammer member projections relative to the spindle projections in the course of rotation.

However, it may be seen from the above that in this prior art construction the hammer member translation is provided by a group of component parts (the intermediate member, holder, pivot), and this appreciably complicates the construction.

Besides, the fork-like driver of the intermediate member transmitting rotation to the hammer member engages the end projection of the hammer member along a line, and thus the collision between the hammer member and the spindle along this line causes high contact stresses resulting in the formation of dents in the surface of the fork-like driver, hammer member jamming, and tool failure.

The reliability of the tool is also affected by the fact that one of the spindle supports is not rigid (the spindle bears against the shaft of the drive motor through the intermediate member). This, firstly, results in a rapid wear of the spindle and hammer member projections on colliding and, secondly, develops an additional dynamic load on the motor shaft.

Also known in the prior art is a rotary impact tool (Cf. U.S. Pat. No. 3,072,232, U.S. Cl. 173-93.5) whose construction is the nearest prototype to the proposed construction. The tool has the same construction of an intermediate member and of the projections on a hammer member and spindle as the analog considered hereinabove. Rotation from a motor to the hammer member is also transmitted through a fork-like driver of the intermediate member and the end projection on the hammer member.

The main difference between this tool and the analog considered hereinabove consists in that the holder accomodating the hammer member is provided with a hole of a rectangular shape. The hammer member is also rectangular in its longitudinal section and mounted to move along the hole in the holder, i.e. the hole in the holder serves as a guide means to provide hammer member motion in a plane perpendicular to the axis of rotation.

Such a construction of the tool is simpler and more reliable than that considered hereinabove.

However, to provide hammer member translation, this construction also utilizes a number of component parts.

Besides, the fork-like driver of the intermediate member engages the end projection of the hammer member in the same way along a line, which causes appreciable contact stresses resulting in rapid wear and failure of the tool.

One of the spindle ends in this construction, as in the aforementioned one, also bears through the intermediate member on the drive motor shaft which takes dynamic loads as the hammer member delivers impacts to the spindle, and that also affects the tool reliability.

SUMMARY OF THE INVENTION

It is an object of the present invention to improve the reliability of a rotary impact tool.

It is another object of the present invention to simplify the construction of a rotary impact tool.

It is still another object of the present invention to reduce the dimensions of a rotary impact tool.

It is yet another object of the present invention to enlarge the field of applications of a rotary impact tool.

With these and other objects in view there is provided a rotary impact tool comprising a drive motor transmitting rotation through an intermediate member to a hammer member embracing a spindle arranged coaxially with the intermediate member and having projections on its outer surface, corresponding to projections made on the inner surface of the hammer member, guide means to provide hammer member translation in a plane perpendicular to the axis of rotation, and a case to accomodate all the component parts of the tool, wherein, according to the invention, the guide means are made eccentric relative to the axis of rotation and disposed directly on the intermediate member.

Such a construction of the tool makes it possible to improve its reliability due to reduction of contact stresses in a mating of the hammer member with the intermediate member.

In one of the embodiments of the invention the guide means are made along parallel chords.

Such a construction of the guide means is the simplest one.

In another embodiment of the present invention the guide means are made curvilinear with a common center of curvature.

Such a construction of the guide means makes it possible, due to variation of the radius of curvature, to vary the mechanical trajectory of the hammer member as it travels in a plane perpendicular to the axis of rotation.

It is preferable to make the intermediate member as a disc.

Such a construction of the intermediate member is the simplest one.

In some cases, when making the intermediate member as a disc, it is preferable to make the guide means in the form of two cuts made on the opposite outer surfaces of the disc and to form a slot in the end face of the hammer member, having a width corresponding to the distance between the cuts.

Such a construction of the guide means is the simplest one for this embodiment of the intermediate member.

When making the intermediate member as a disc, it is most preferable to make the guide means as an end projection extending into a corresponding slot made in the end face of the hammer member.

Such a construction of the guide means makes it possible to improve the reliability of the tool, to reduce its dimensions, and to enlarge the field of its applications.

When making the guide means as the end projection, it is preferable to provide the instrument with an aligning disc arranged at the free end face of the hammer member coaxially with the main disc and having guide means identical with these on the main disc, and to make both the end faces of the hammer member identical.

Such a construction makes it possible to improve the reliability of the tool due to a more exact orientation of the hammer member projections relative to the spindle projections.

In some cases it is preferable to make the intermediate member as a holder embracing the hammer member, to form the guide means as a through slot, and to make two cuts on the outer surface of the hammer member with a distance therebetween corresponding to the slot width.

Such an embodiment of the tool makes it possible to improve its reliability due to a more exact orientation of the hammer member relative to the axis of rotation and due to the reduction of dynamic loads on the shaft of the drive motor.

It is also preferable to mount the intermediate member on the spindle bearing with its both ends on the case and to provide on the outer surface of the intermediate member an element of kinematic coupling with the drive motor.

Such a construction of the tool makes it possible to improve its reliability due to the reduction of loads on the motor, as a result of which, on collisions, a major portion of loads is transmitted from the spindle, hammer member and intermediate member directly to the case. Besides, such a construction permits a substantial reduction of the tool dimensions. This construction also allows to make tool receiving shanks on both spindle ends, which enables the tool rotation to be reversed due to the use of one or another shank with the same direction of rotation of the spindle, hammer member and drive motor, i.e. makes it possible to use a nonreversible motor whose power output and reliability are much higher than these of a comparable reversible motor.

It is preferable to make element of kinematic coupling with the drive motor as a bevel gear ring meshing with a bevel gear fitted on the shaft of the drive motor and having its axis arranged at an angle to the spindle axis.

Such a construction of the tool makes it possible to reduce the tool dimensions along the vertical extent.

In some cases it is preferable to make the element of kinematic coupling as a pulley connected by a belt with a pulley fitted on the motor shaft whose axis is parallel to the spindle axis.

Such a construction of the tool makes it possible to reduce dynamic loads acting on the drive motor.

In many cases it is preferable to make the element of kinematic coupling as a spur gear ring meshing with a spur gear fitted on the shaft of the drive motor and having its axis parallel to the spindle axis.

Such a construction provides maximum compactness and reliability of a transmission between the drive motor and the intermediate member.

In some cases it is preferable to provide the spindle with a central tapped hole receiving a screw with a longitudinal keyway interacting with a key fixed in the case.

Such a construction of the tool makes it possible to utilize the tool as a jack, turnbuckle, vice and other similar devices.

These and other objects of the present invention will become more apparent upon further detailed description of its embodiments taken with reference to the accompanying drawings in which:

BRIEF DESCRIPTION OF THE ACCOMPANYING DRAWINGS

DETAILED DESCRIPTION OF THE INVENTION

Figure 1:
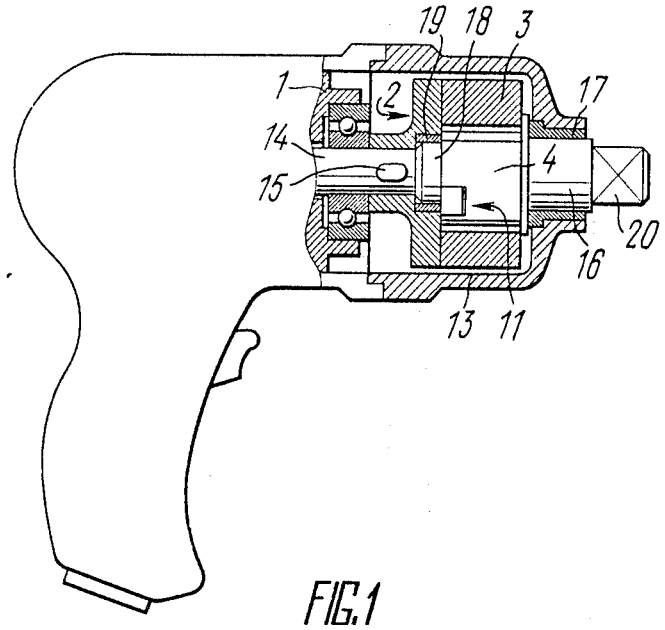
FIG. 1 shows a general view of the tool partly in section.

A rotary impact tool made in accordance with the present invention comprises a drive motor 1 (FIG. 1) transmitting its rotation through an intermediate member 2 to a hammer member 3 embracing a spindle 4 arranged coaxially with the intermediate member 2 and having projections 5 and 6 (FIG. 2) made on the outer surface 7 thereof and corresponding to projections 8 and 9 (FIGS. 3 to 6) made on the inner working surface 10 of the hammer member 3. The tool also includes guide means 11 to provide translation of the hammer member 3 in a plane perpendicular to the axis 12 (FIG. 2) of rotation. A case 13 is intended to accomodate all the aforementioned component parts of the tool. The guide means 11 (FIG. 3) are made eccentric relative to the axis 12 (FIG. 2) of rotation and disposed directly on the intermediate member 2 transmitting rotation to the hammer member 3.

The intermediate member 2 is mounted directly on the shaft 14 (FIG. 1) of the drive motor 1 and joined thereto, for example, by means of a key 15. The spindle 4 bears with its one end 16 on a bearing 17 in the case 13 and with its other end 18 extends into a bearing 19 in the intermediate member 2, i.e. the spindle bears through the intermediate member on the shaft 14 on the drive motor 1. Made at the end 16 of the spindle 4 is a shank 20 to fix a working member thereto (not shown in the drawing).

Making the guide means 11 (FIG. 2) along parallel chords 21 and 22 is the simplest one.

In another embodiment of the tool the guide means 11 (FIG. 4) are made curvilinear with a common center of curvature lying on the axis 24 of symmetry of the intermediate member 2.

Figure 2:
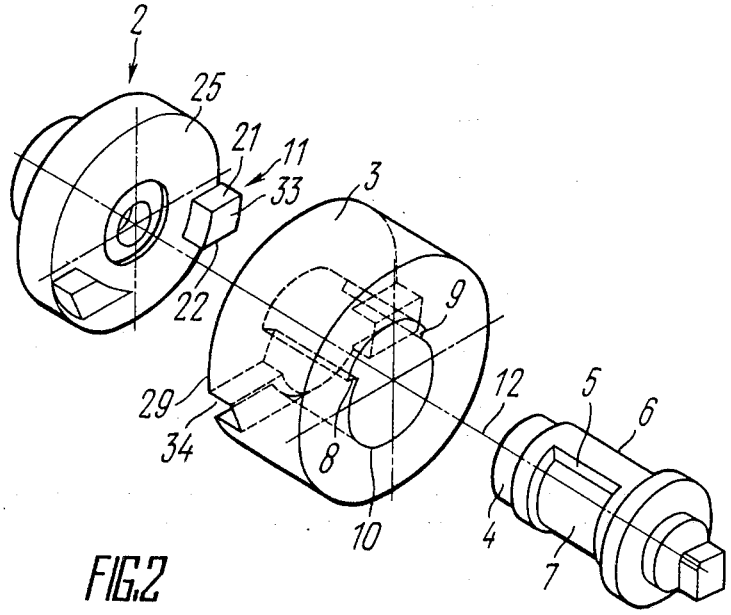
FIG. 2 shows a perspective exploded view of the main portion of the tool.

FIG. 2 shows the embodiment of the tool in which the intermediate member 2 is made as a disc 25. The disc 25 has a hub for fitting onto the shaft 14 of the drive motor 1.

Figure 7:
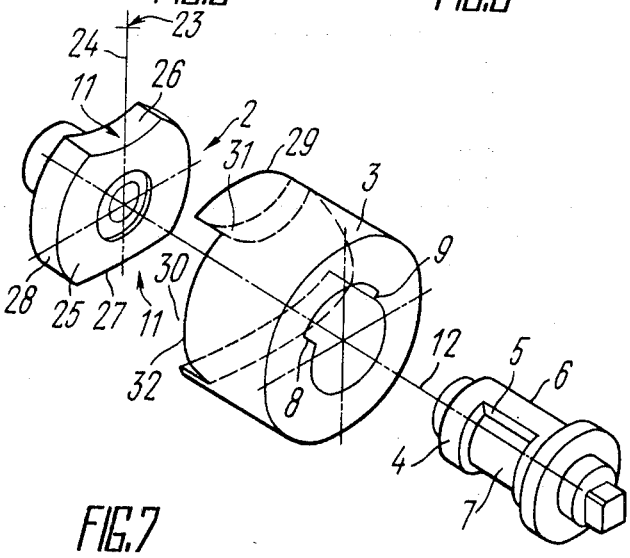
FIG. 7 shows a perspective view of the main portion of the tool, illustrating interaction of the intermediate member, hammer member and spindle in one of the embodiments of the guide means.

FIG. 7 shows the instance of making the guide means 11 on the disc 25 in the form of two cuts 26 and 27 on the outer surface 28 of the disc 25. In this case the hammer member 3 has a slot 30 made in the end face 29 and having a width corresponding to the distance between the cuts 26 and 27.

Both the cuts 26 and 27 on the disc 25 and respective surfaces 31 and 32 of the slot 30 have a common center 23 of curvature and respectively equal radii of curvature. The cuts 26 and 27 on the disc 25 may be made just as well along rectilinear parallel chords (not shown in the drawing). In this case the slot 30 in the end face 29 of the hammer member 3 is also made rectilinear.

In many cases it is preferable to make the guide means 11 as an end projection 33 (FIG. 2) extending into a respective slot 34 made in the end face 29 of the hammer member 3.

The side surfaces of the projection 33 in this case are made rectilinear along parallel chords 21 and 22. The end projection may be made just as well on the hammer member, with the slot corresponding thereto being made in the end face of the disc (not shown in the drawing).

It is apparent that in both aforementioned cases the side surfaces of the projection 33 and the slot 34 may be made curvilinear with a common center of curvature.

Figure 8:
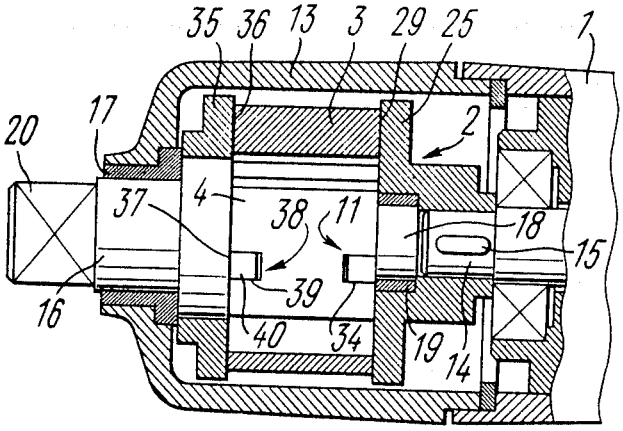
FIG. 8 shows a partial sectional view of the tool made according to the embodiment with an aligning disc.

In the embodiment shown in FIG. 8 the tool is additionally provided with an aligning disc 35 arranged at the free end face 36 of the hammer member 3 coaxially with the disc 25.

The end face 37 of the aligning disc 35 is provided with guide means 38 identical with the guide means 11 of the disc 25. The end faces 29 and 36 of the hammer member 3 are also made identical. The end face 36 of the hammer member 3 is provided with a slot 39 identical with the slot 34 in the end face 29 of the hammer member 3. The slot 39 receives the guide means 38 made as the end projection 40, and the slot 34 receives the guide means 11 made as the end projection 33.

Figure 9:
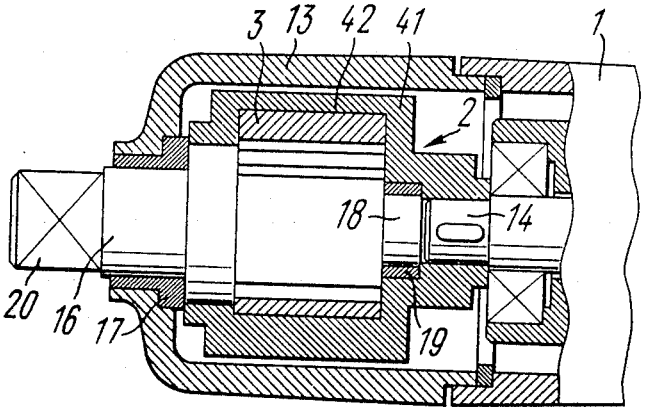
FIG. 9 shows a partial sectional view of the tool made according to the embodiment in which the intermediate member is made as a holder.
Figure 10:
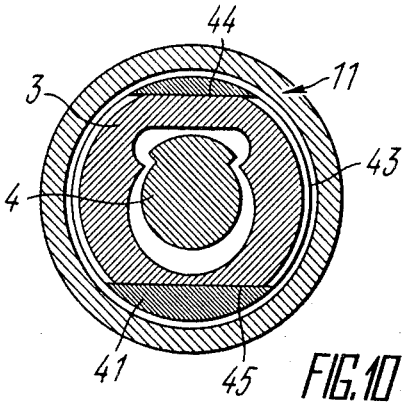
FIG. 10 is a sectional view taken along the line X—X of FIG. 9.

FIG. 9 shows the embodiment of the tool in which the intermediate member 2 is made as a holder 41 (FIG. 10) embracing the hammer member 3, the guide means represent a through slot 42, and the outer surface 43 of the hammer member 3 is provided with two cuts 44 and 45 having distance therebetween corresponding to the width of the slot 42.

Figure 11:
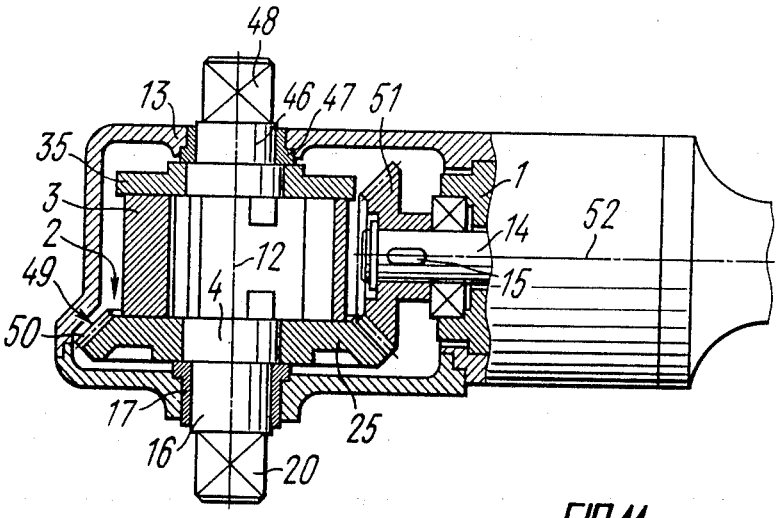
FIG. 11 shows a partial sectional view of the tool made according to the embodiment in which the outer surface of the intermediate member is provided with an element of kinematic coupling with the drive motor, made as a bevel gear.

FIG. 11 shows the embodiment of the tool in which the intermediate member 2 is mounted on the spindle 4, and the spindle 4 bears with its both ends 16 and 46 on bearings 17 and 47 fitted in the case 13. Both the ends 16 and 46 of the spindle 4 are provided with shanks 20 and 48 carrying a working member, such as a wrench fitted over a nut (not shown in the drawing).

The outer surface of the intermediate member 2 is complete with an element 49 of kinematic coupling between the intermediate member 2 and the drive motor 1. FIG. 11 shows an embodiment of the element 49 of kinematic coupling made as a bevel gear ring 50 with its teeth cut directly in the intermediate member 2 made as the disc 25. The gear ring 50 meshes with a bevel gear 51 fitted on the shaft 14 of the drive motor 1. The bevel gear 51 is secured to the shaft 14 by the key 15. The axis 52 of the motor 1 is perpendicular to the axis 12 of the spindle 4. The axis 52 may just as well make any other angle (not shown in the drawing) with the axis 12.

Figure 12:
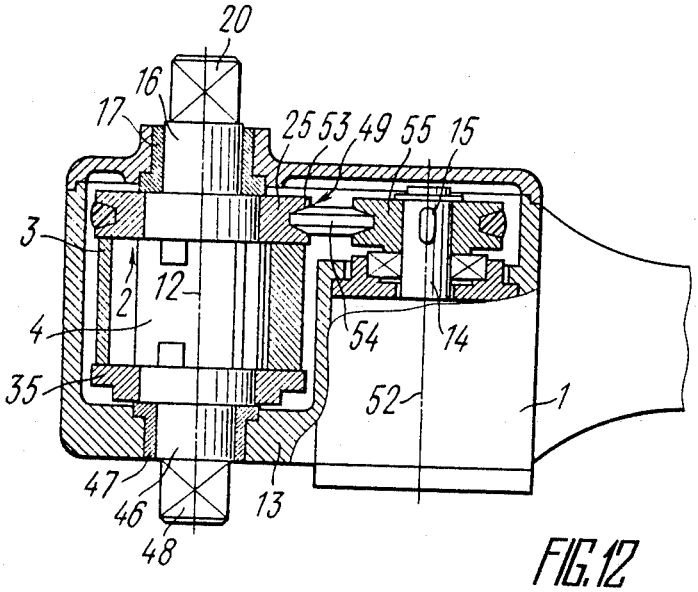
FIG. 12 shows a partial sectional view of the tool made according to the embodiment in which the element of kinematic coupling is made as a pulley.

FIG. 12 shows an embodiment of the element 49 made as a pulley 53 connected by a belt 54 with a pulley 55 fitted on the shaft 14 of the motor 1. The axis 52 of the motor 1 is parallel to the axis 12 of the spindle 4.

Figure 13:
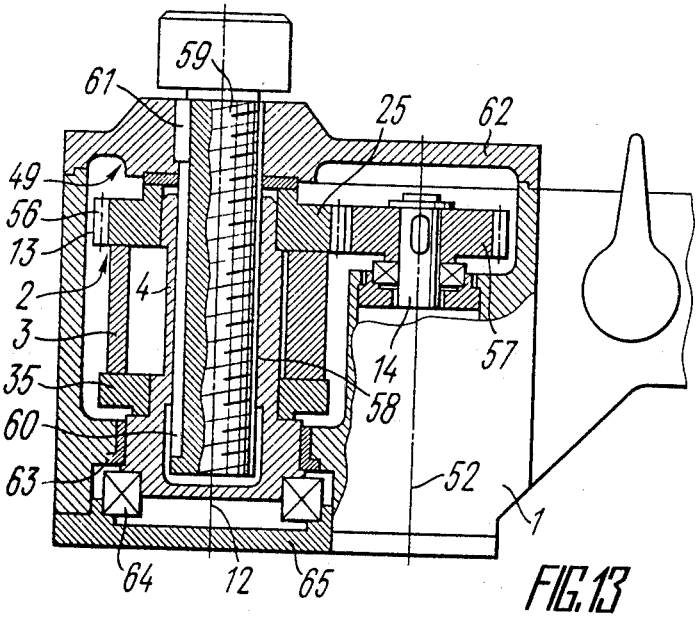
FIG. 13 shows a partial sectional view of the tool made according to the embodiment in which the element of kinematic coupling is made as a spur gear.

FIG. 13 shows an embodiment of the element 49 made as a spur gear ring 56 meshing with a spur gear 57 fitted on the shaft 14 of the drive motor 1 whose axis 52 is parallel to the axis 12 of the spindle 4.

FIGS. 11, 12, and 13 show the embodiments in which the intermediate member 2 is made as the disc 25. However, the intermediate member in these embodiments may just as well be made as a holder (not shown in the drawing).

With another application of the tool, such as when utilizing it as a jack, the spindle 4 (FIG. 13) is provided with a tapped hole 58 receiving a screw 59 with a longitudinal keyway 60. The keyway 60 receives a key 61 fixed in a cap 62 of the case 13. The spindle 4 is supported within the case 13 by means of a sleeve bearing 63 and a thrust bearing 64 fitted in a cap 65 of the case 13.

The rotary impact tool made in accordance with the present invention operates in the following way.

When preparing for operation, a working member (not shown in the drawing) is connected to the shank 20 of the spindle 4. Thereupon, the motor 1 is energized, and rotation from the shaft 14 is transmitted through the intermediate member 2 due to the guide means 11 (FIG. 2) to the hammer member 3. As the hammer member 3 rotates in a clockwise direction (FIG. 3), the projection 8 periodically (on every revolution) delivers impacts to the projection 5. In so doing, the kinetic energy accumulated by the hammer member 3 in the course of its rotation is delivered to the spindle 4 and it rotates through some angle thus transmitting motion to a working member and then stops.

Figure 3:
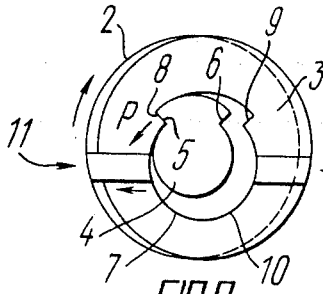
FIG. 3 is a sectional view taken along the line 1—1 of FIG. 1, showing mutual arrangement of the main component parts of the tool at the instant of collision.
Figure 4:
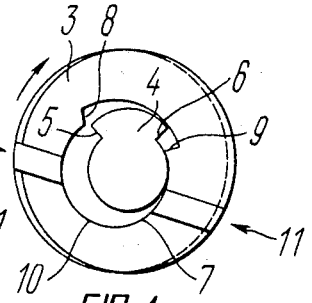
FIG. 4 is a sectional view corresponding to FIG. 3 at the instant of disengagement of the hammer member and spindle projection.
Figure 5:
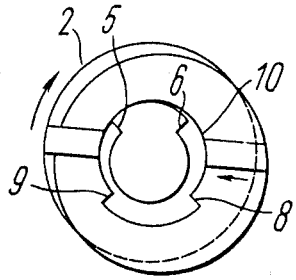
FIG. 5 is a sectional view corresponding to FIG. 3 after the spindle has turned through 180°.
Figure 6:
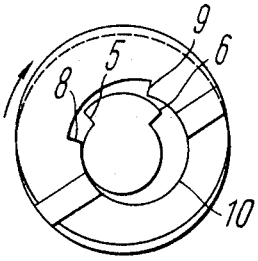
FIG. 6 is a sectional view corresponding to FIG. 3 prior to collision.

The hammer member 3 and the intermediate member 2 stop together with the spindle 4. However, the hammer member 3 continues to receive torque from the drive motor 1 (FIG. 1) through the intermediate member 2. Under the influence of this torque and spindle reaction P (FIG. 3) transmitted to the hammer member 3 at the point of engagement of the projection 8 with the projection 5, the hammer member 3 starts to move in a plane perpendicular to the axis of rotation along the guide means 11 of the intermediate member 2, the projection 8 disengaging from the projection 5. This movement continues until the projection 9 on the inner working surface 10 of the hammer member 3 is forced against the surface 7 of the spindle 4 (FIG.). After that, the hammer member 3 starts to rotate together with the intermediate member 2 as a single unit and accumulates energy for another impact. This rotation continues until the inner surface 10 of the hammer member 3 engages the projection 5 on the outer surface of the spindle 4, whereupon concurrently with the rotation, due to interaction between the inner working surface 10 of the hammer member 3 and the projection 5, the hammer member 3 moves along the guide means 11, the projection 9 (FIG. 5) departing from the surface 7 of the spindle 4 and the projection 8 approaching thereto. The hammer member 3 moves along the guide means 11 until the projection 8 is forced against the surface 7 of the spindle 4. This occurs at the instant when the projection 9 engages the projection 5. Thereupon, the hammer member 3 (FIG. 6) and the intermediate member 2 again rotate as a single unit without varying their relative position. After that the projection 8 delivers an impact to the projection 5, and the cycle is repeated. Before the impact occurs, the projection 9 comes off the projection 6 (FIG. 3). This is required to enable the hammer member 3 to travel after the impact along the guide means 11 as the projection 8 disengages from the projection 5. As the drive motor 1, intermediate member 2 and hammer member 3 rotate in the opposite (counterclockwise) direction, the impacts are delivered by the projection 9 of the hammer member 3 to the projection 6 of the spindle 4, and in other respects the tool operation is similar to that described hereinabove.

Thus, the intermediate member 2 with the guide means 11 completely provide a required mechanical trajectory of the hammer member 3 (rotation and translation in the plane perpendicular to the axis of rotation) in the course of its interaction with the spindle 4. This makes it possible to minimize the number of component parts of the tool and to simplify its construction. Besides, the guide means 11 of the intermediate member 2 and the hammer member 3 always interact along a plane, which provides the reduction of contact stresses.

When the guide means 11 (FIG. 2) are made along parallel chords 21 and 22, the movement of the hammer member 3 (FIG. 3), as the projection 8 disengages from the projection 5, occurs along a straight line.

Such a construction of the guide means 11 is the simplest one.

When the guide means 11 (FIG. 7) are made curvilinear with a common center 23 of curvature lying on the axis 24 of symmetry of the intermediate member 2, the hammer member 3 moves along the guide means 11 in a curve around the center 23 of curvature. Such a construction of the guide means 11 makes it possible, due to variation of the radius of curvature, to vary the mechanical trajectory of the hammer member as it moves in the plane perpendicular to the axis of rotation. This provides an easier disengagement of the projection 8 of the hammer member 3 from the projection 5 of the spindle 4.

When the intermediate member 2 (FIG. 2) is made as the disc 25, the tool operates exactly in accordance with the sequence considered hereinabove. Such a construction of the intermediate member 2 is the simplest one.

When the guide means 11 (FIG. 7) on the disc 25 are made as two cuts 26 and 27, the hammer member 3 moves along the cuts 26 and 27. After the impact, the hammer member 3 shifts along the cuts 26 and 27. In so doing, it turns around the center 23 of curvature and the projection 8 disengages from the projection 5. Making the guide means 11 on the disc 25 as two cuts is the simplest one.

In one embodiment of the guide means 11 made as the end projection 38 on the disc 25 (FIG. 2), as the projection 8 disengages from the projection 5, the slot 34 made in the end face 29 of the hammer member 3 slides over the projection 33. In other respects the tool operation is identical with that described hereinabove.

This embodiment of the tool is the most compact and allows to obtain the least possible overall dimensions of the tool. Due to the fact that the outer surface of the disc 25 in such an embodiment is free, a new arrangement of the tool component parts may be obtained making it possible to reduce dynamic loads on the shaft 14 of the drive motor. If there is the aligning disc 35 (FIG. 8), the rotation of the hammer member 3 in the course of the tool operation is transmitted through the slot 39 in the other end face 36 and projection 40 to the aligning disc 35. This causes simultaneous rotation of the disc 25, hammer member 3 and aligning disc 35. As the hammer member 3 moves, the slot 34 slides along the projections 33 of the disc 25.

Simultaneously, the slot 39 slides along the projection 40. Due to identity of the projections 33 and 40 and of the slots 34 and 39, both the end faces of the hammer member move in synchronism throughout the entire process of operation of the tool.

When making the intermediate member 2 as the holder 41 (FIGS. 9, 10) embracing the hammer member 3, the rotation from the drive motor 1 is transmitted to the hammer member 3 via the through slot 42 made in the holder 41. As the hammer member 3 moves in the plane perpendicular to the axis of rotation, the cuts 44 and 45 slide along the slot 42, thus providing after impact disengagement of the projections of the hammer member 3 and spindle 4. Due to the fact that the cuts 44 and 45 are made along the entire length of the hammer member 3, there is provided a more exact positioning of the projections of the hammer member 3 with respect to the projections of the spindle 4.

In the embodiment of the tool with the intermediate member 2 mounted on the spindle 4 (FIG. 11) bearing with its both ends 16 and 46 on the case 13, after the drive motor 1 is energized, its rotation is transmitted to the intermediate member 2 through the element 49 of kinematic coupling.

Due to the fact that both the ends 16 and 46 of the spindle 4 are provided with the working shanks 20 and 48, the rotation is reversed by connecting one or another shank to a tool.

Since, on collisions, a major portion of dynamic loads from the spindle 4, hammer member 3 and intermediate member 2 is transmitted directly to the case 13, dynamic loads acting on the motor are reduced. Besides, such an embodiment of the tool makes it possible to reduce the overall dimensions of the tool.

In the embodiment of the tool with the element 49 of kinematic coupling made as the bevel gear ring 50, the rotation from the drive motor 1 is transmitted to the intermediate member 2 through the bevel gear 51 and bevel gear ring 50. Such a construction of the tool makes it possible to arrange the drive motor 1 at any angle to the axis of the spindle 4. This provides minimum dimensions of the tool along the vertical extent thereof.

In another embodiment of the tool having the element 49 of kinematic coupling with the drive motor 1, made as the pulley 53 (FIG. 12), the rotation from the drive motor 1 is transmitted to the intermediate member 2 through the pulley 55 mounted on the shaft 14 of the drive motor 1, belt 54 and pulley 53. Due to the fact that a belt drive exhibits good damping properties, such an embodiment of the tool makes it possible to reduce still further dynamic loads on the drive motor 1 and, hence, to prolong the service life of the tool.

In still another embodiment of the tool having the element 49 of kinematic coupling with the drive motor 1, made as the spur gear ring 56 (FIG. 13), the rotation from the drive motor 1 is transmitted to the intermediate member 2 through the spur gear 57 and gear ring 56. Such a construction of the element 49 of kinematic coupling with the drive motor is the simplest and most compact.

When providing the spindle 4 with the central tapped hole 58 and mounting therein the screw 59 (FIG. 13), the tool operates as a lifting device (such as a jack), the drive motor 1, the intermediate member 2, the hammer member 3 and the spindle 4 operating as described above. After the impact is delivered to the spindle 4, it rotates through some angle and the screw 59 is translated along the axis of the spindle 4. On translation of the screw 59, the keyway 60 slides along the key 61 fixed in the cap 65 of the case 13 and holding the screw 59 against rotation together with the spindle 4. The translation of the screw 59 is reversed by reversing the drive motor 1.

Such an embodiment of the rotary impact tool makes it possible to provide the translation of a tool driven thereby and to enlarge substantially the field of application thereof.

Thus, there is provided an improvement of the service life and reliability of the tool, simplification of its construction, reduction of its dimensions, and enlargement of the field of its application.

It is to be understood that the present invention is not limited to the particular embodiments shown and described hereinabove and that numerous other variations may be made in the rotary impact tool without departing from the spirit and scope of the invention as defined in the claims below.

What is claimed is:

1. A rotary impact tool comprising a case enclosing a drive motor, a hammer member having projections on the inner surface thereof, a two-ended, intermediate member having an outer surface and transmitting rotation from said motor to said hammer member and having guide means disposed eccentrically relative to the axis of rotation of said hammer member and intended to transmit rotation from said drive motor to said hammer member as well as to provide translation of said hammer member in a plane perpendicular to the axis of rotation, a spindle arranged coaxially with said intermediate member, embraced by the inner working surface of said hammer member and having on the outer surface thereof projections corresponding to the projections made on the inner working surface of said hammer member to transmit impulse rotation to said spindle; said intermediate member consisting of a disk; said hammer member having in the end face thereof slots, and said guide means consisting of end projections extending into said slots in the end face of said hammer member.

2. A rotary impact tool comprising, in combination:

a case enclosing a drive motor, a hammer member having projections on the inner surface thereof, a disk having an outer surface and transmitting rotation from said motor to said hammer member and having guide means disposed along parallel chords and eccentrically relative to the axis of rotation of said drive motor and to provide translation of said hammer member in a plane perpendicular to the axis of rotation, a spindle arranged coaxially with said disk, embraced by the inner working surface of said hammer and having on the outer surface thereof projections corresponding to the projections made on the inner working surface of said hammer member to transmit impulse rotation to said spindle; said hammer member having, in the end face thereof, slots, and said guide means consisting of end projections extending into said slots in the end face of said hammer member.

* * * * *